United States Patent [19]

Batty

[11] Patent Number: 4,820,204

[45] Date of Patent: Apr. 11, 1989

[54] MODULAR ELECTRICAL CONNECTOR ASSEMBLY

[75] Inventor: William Batty, Winston-Salem, N.C.

[73] Assignee: AMP Incorporated, Harrisburg, Pa.

[21] Appl. No.: 940,835

[22] Filed: Dec. 12, 1986

[51] Int. Cl.[4] ..... H01R 13/64

[52] U.S. Cl. ..... 439/681; 439/695; 439/701

[58] Field of Search ..... 439/677, 678, 679, 680, 439/681, 674, 670, 671, 672, 673, 312-321, 323, 333, 334, 335

[56] References Cited

U.S. PATENT DOCUMENTS

| | | | |
|---|---|---|---|
| 3,221,292 | 11/1965 | Swanson et al. | 339/217 |
| 3,551,880 | 12/1970 | Hartwell | 339/89 |
| 3,840,839 | 10/1984 | Smaczny et al. | 339/49 R |
| 3,901,574 | 8/1975 | Paullus et al. | 339/90 R |
| 3,989,337 | 11/1976 | Stelline | 339/90 R |
| 4,090,759 | 5/1978 | Herrmann, Jr. | 339/60 M |
| 4,166,664 | 9/1979 | Herrmann | 439/352 |
| 4,193,655 | 3/1980 | Herrmann, Jr. | 339/31 R |
| 4,229,064 | 10/1980 | Vetter et al. | 339/186 M |
| 4,364,626 | 12/1982 | Price | 439/680 |
| 4,443,052 | 4/1984 | Eaby et al. | 339/113 R |
| 4,477,022 | 10/1984 | Shuey et al. | 339/59 M |
| 4,544,220 | 10/1985 | Aiello et al. | 339/59 M |

FOREIGN PATENT DOCUMENTS 2358759 6/1980 France .

OTHER PUBLICATIONS

U.S. patent application Ser. No. 235,455 filed 2-18-81.
"Developing a Metal shell Circular Plastic Connector", by Daniel G. Eaby, presented at the Fifteenth Annual Connectors and Interconnection Technology Symposium, Nov. 1-2, 1982, Amp Incorporated.
EPO Search Report.

*Primary Examiner*—David Pirlot
*Attorney, Agent, or Firm*—Robert W. Pitts

[57] ABSTRACT

A modular electrical connector assembly consisting of a plurality of components which can be assembled in a number of different configurations is disclosed. Each connector consists of an outer body (100, 200) and an inner body (300, 400). The inner and outer bodies are separately and independently keyed and each mates with a corresponding inner or outer body in only one configuration. The inner body is keyed by providing distinct cross-sections for intermating posts (310) and cavities (410). The outer bodies (100, 200) are latched together by a plurality of collects (202) on one connector (200) which are held in engagement with a cylindrical ridge (130) on the other connector by a spring loaded shiftable sleeve (150). Keys (142) on one connector are received in keyslots (212), between adjacent collets (202) on the other connector. Conductors (30) in distinct and corresponding ordered arrays can be interconnected and the circuit patterns need not be changed in order to provide for connector modularity.

26 Claims, 14 Drawing Sheets

2
6
36
156
102
130
310b
142
108
124
300
158
310a
154
100
150
152
310c
4
36
8
200
206
212
218
210
208
400
410b
224
410c
204
208
210
214
410a
202

MODULAR ELECTRICAL CONNECTOR ASSEMBLY

BACKGROUND OF THE INVENTION

1. Field of the Invention

This invention relates to an electrical connector assembly of the type employing a plurality of interchangeable parts which can be assembled to form a plurality of distinct connector configurations, such that only those connectors having the same mutual orientation can be intermated.

2. Description of the Prior Art

Conventional pin and socket connector assemblies generally are keyed to permit mating in only one specific orientation. This is true whether the configuration of the connector is circular or generally rectangular in shape. The requirement that only properly keyed connector assemblies be intermatable is necessary because each connector assembly is intended to interconnect corresponding conductors, for example specific color coded wires in multiconductor cables. With conventional connectors of this construction, the need to appropriately key the connectors requires that non-matable connectors generally require separately molded insulative housings.

The present invention permits a keyed connector assembly to be assembled from a plurality of separate components. For example, the instant invention can permit a multi-pin connector assembly to easily be assembled in twelve separate configurations. The prior art is not known to disclose any connector assembly having this capability.

U.S. Pat. No. 3,551,880 discloses a connector having a plurality of pins and sockets mounted on separate housings, each uniquely keyed to the other so that the two housings are intermatable only in one angular orientation.

U.S. Pat. Nos. 3,901,574; 4,443,052; and 4,477,022 show circular plastic connectors having a helical outer locking ring. In the two latter patents, pins extending outwardly from a flat base are insertable in sockets located in passages in the other connector housing. The housings are keyed for only one angular orientation by peripheral tongue and groove keys.

U.S. Pat. No. 3,989,337 shows a circular two-piece connector assembly. Each connector half has an integrally molded main body with a rotatable locking collar and coupling pin on the exterior of the respective main bodies. The main bodies have dissimilar shaped passages, some rectangular and some circular. Pin terminals in one housing extend from the front of one body while socket terminals are located within the passages in the other connector. This unique pattern of terminals and passages is fixed relative to tongue and groove keys on the bodies so that this pattern has only a singular orientation.

Another circular connector having a plurality of contacts is disclosed in U.S. Pat. No. 4,090,759. In this connector, the terminals are mounted within housing posts and cavities which intermate when the two connector halves are mated.

U.S. Pat. No. 4,193,655 discloses a modular electrical connector assembly having a plurality of interchangeable components which can be assembled in a variety of configurations. Both pin and socket inserts can be mounted in plug and receptacle shells in three angular orientations. Mating keys and keyways on the plug and receptacle shells then ensure that the two connector halves can only mate if the inserts are at the same angular orientation. However, this patent discloses a connector employing only five terminals, and since any post is matable with any cavity, the angular orientations differ from each other only by fractions of the angular dispersion of adjacent terminals. Thus both the number of terminal positions and the number of angular orientations which can be employed for this configuration are practically limited by the size of the keys and keyways which can be manufactured. This device differs from the present invention because the inserts themselves are not mutually keyed or polarized. Furthermore, this prior art device does not permit the conductor circuit pattern to remain stationary and independent of the keying or polarization.

Other connectors, such as that shown in U.S. Pat. No. 4,544,220, using matable posts and cavities employ posts which are polarized with respect to cavities, by altering the cross-section of one pair of posts and cavities with respect to the others. These connectors, however, are not of modular construction and do not permit a plurality of configurations to be assembled using the same interchangeable parts.

SUMMARY OF THE INVENTION

This invention relates to a modular electrical connector assembly for interconnecting a plurality of conductors in two separate groups. The conductors in each group are each distinct, one from another, so that each separate group of conductors forms an ordered array. For example, each group of conductors can consist of a multiconductor cable with each conductor having a separate identity. The group of conductors could also consist of the traces on a printed circuit board, each of which would be distinct from the others.

The assembly consists of first and second connectors, each of which can be assembled from a plurality of interchangeable parts. Each connector would consist of an outer housing or shell member and an inner body which could be inserted within the bore of the outer shell member. The outer housings of each connector are matable and appropriate inter-engaging keys are provided to ensure that the outer housing members are mutually polarized, thus permitting mating of the outer housing assemblies in only one angular configuration. The inner bodies are also separately intermatable and are separately polarized. The inner bodies can, however, be affixed to the outer housing members in a plurality of angular orientations. In the preferred embodiment of this invention, each inner body can be inserted in six positions, each spaced apart by 60 degrees. Keying means are provided on the inner bodies to ensure that the inner bodies mate only if they are in the same angular orientation.

In the preferred embodiment of this invention, the inner bodies consist of intermatable members having posts or cavities on the front end, the posts being received within appropriate cavities upon mating. By providing one or more posts with a unique cross-section, insertable into only a cavity having the same cross-section, the inner bodies can be simply polarized. In this manner, a plurality of distinct first and second connectors can be constructed, with contact terminals in the first and second connectors interconnecting appropriate conductors. These distinct connector assemblies can be constructed employing interchangeable parts, thus eliminating the need for a separately molded housing for each distinct connector assembly.

In the preferred embodiment of this invention, the connector housings are circular in configuration with the inner bodies comprising cylindrical members insertable within the bore of the cylindrical outer members. Flexible collets are provided on the front of one of the outer housing members permitting engagement between the two connectors by a simple longitudinal push/pull arrangement. These collets engage a companion ridge and groove and are held in place by a spring-loaded shiftable sleeve. In the preferred embodiment of this invention, the keying means for the outer housing members is accomplished by providing asymmetrically distributed collet fingers. Raised keys on the member having a shiftable sleeve is insertable between adjacent collet fingers.

In the preferred embodiment of this invention, the discrete angular orientations of the inner bodies can be provided through the use of two-piece inner bodies into which the contact terminals are mounted. The front contact holding inner body would have either the post or cavity configuration and could be assembled to the rear contact holding inner body member in a plurality of angular orientations. The rear contact holder could then be attached within the bore of the outer housing members in only a single angular orientation, thus maintaining the position of individual conductors in the circuit pattern.

BRIEF DESCRIPTION OF THE DRAWINGS

FIG. 3 is an exploded perspective view of one half of the connector assembly illustrating the interchangeability of the component parts.

FIG. 4 is a view of a partially assembled connector half showing the manner in which the terminals are mounted within the connector.

FIG. 9 is a cross-section taken along section lines 9—9 in FIG. 7.

FIGS. 13A–13E are schematic views showing the manner in which the two outer connector halves are intermated.

DETAILED DESCRIPTION OF THE PREFERRED EMBODIMENTS

First Embodiment

Figure 1:
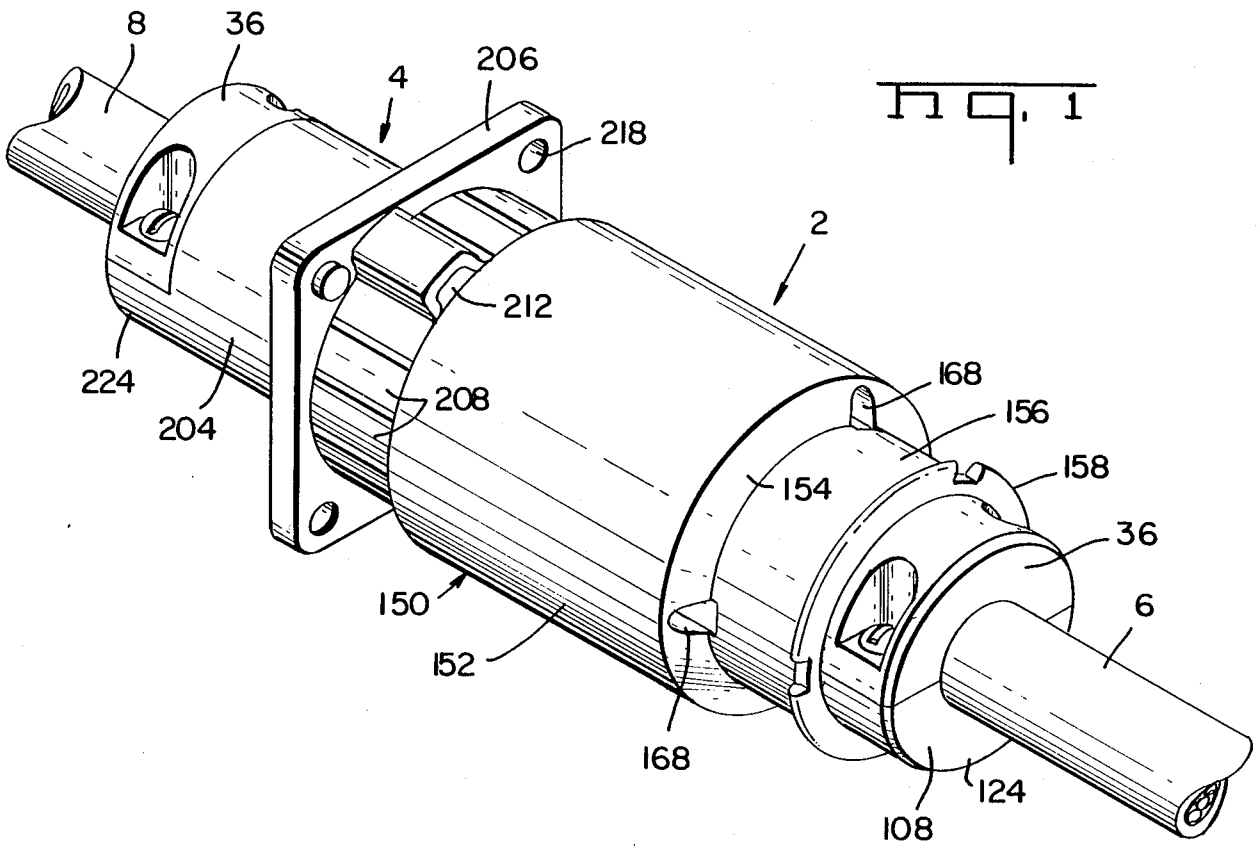
FIG. 1 is a view of an intermated two part connector assembly.
Figure 2:
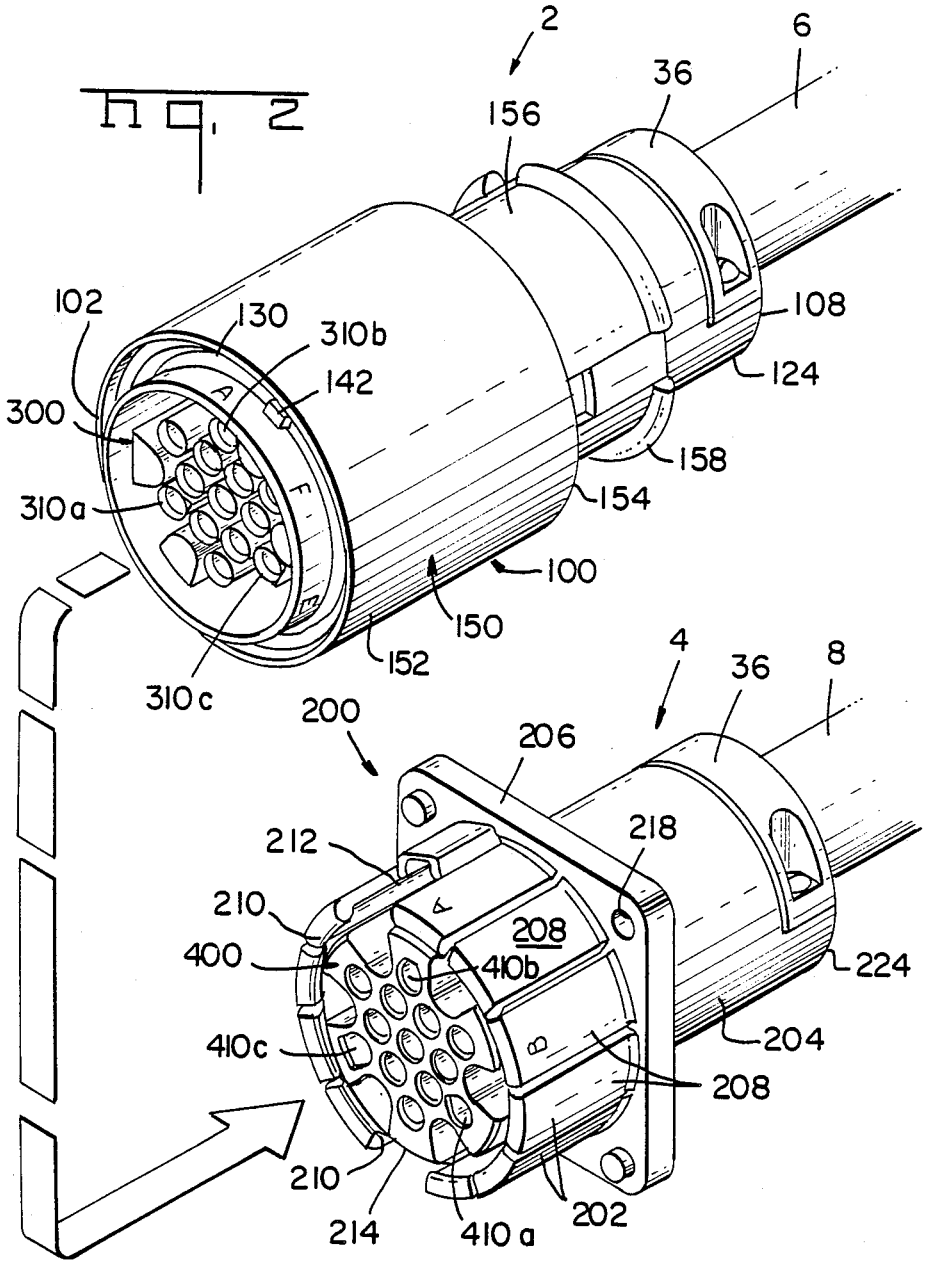
FIG. 2 shows the same two part connector assembly as depicted in FIG. 1, with the connectors disengaged.
Figure 1:
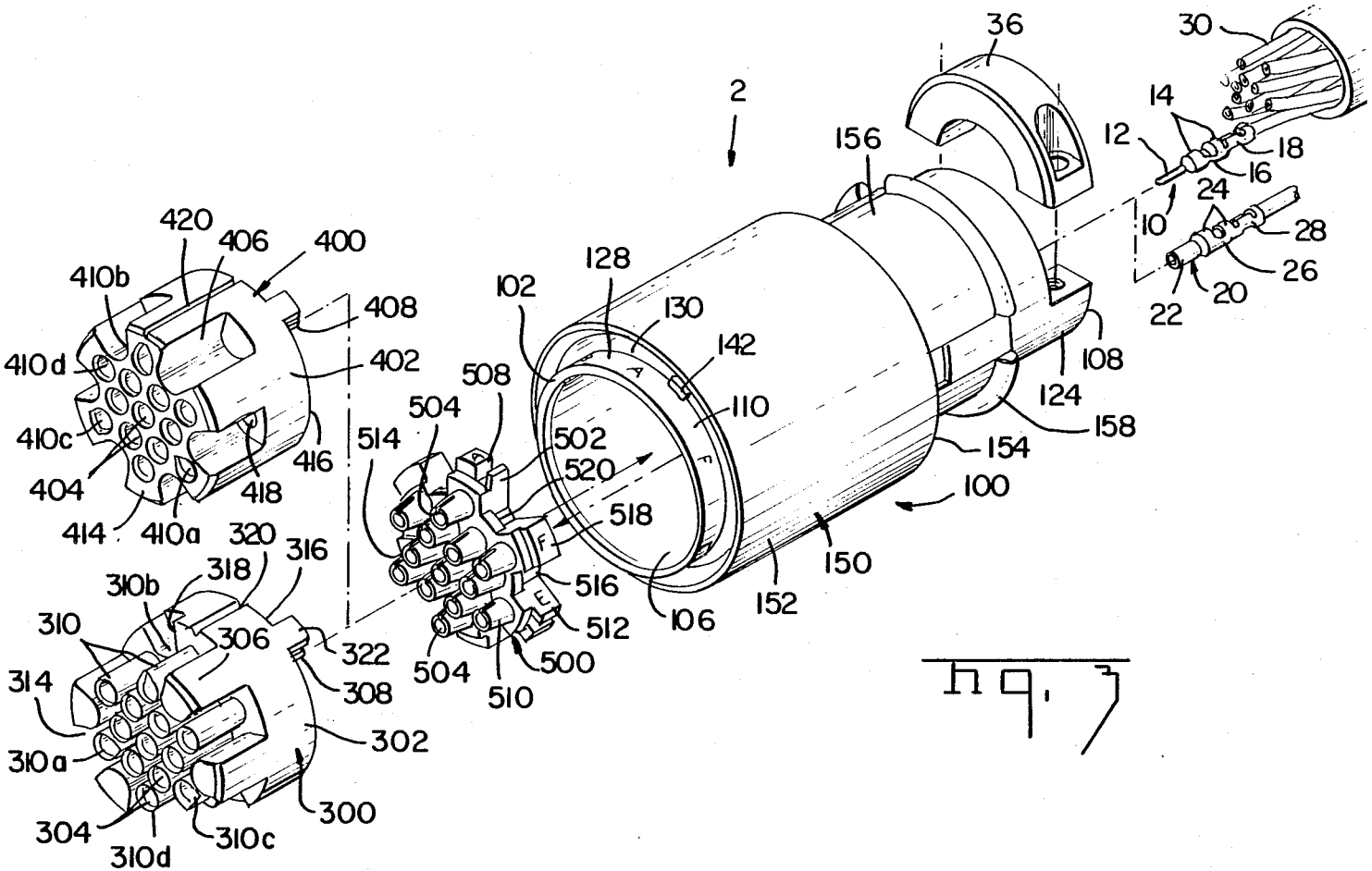
Figure 7:
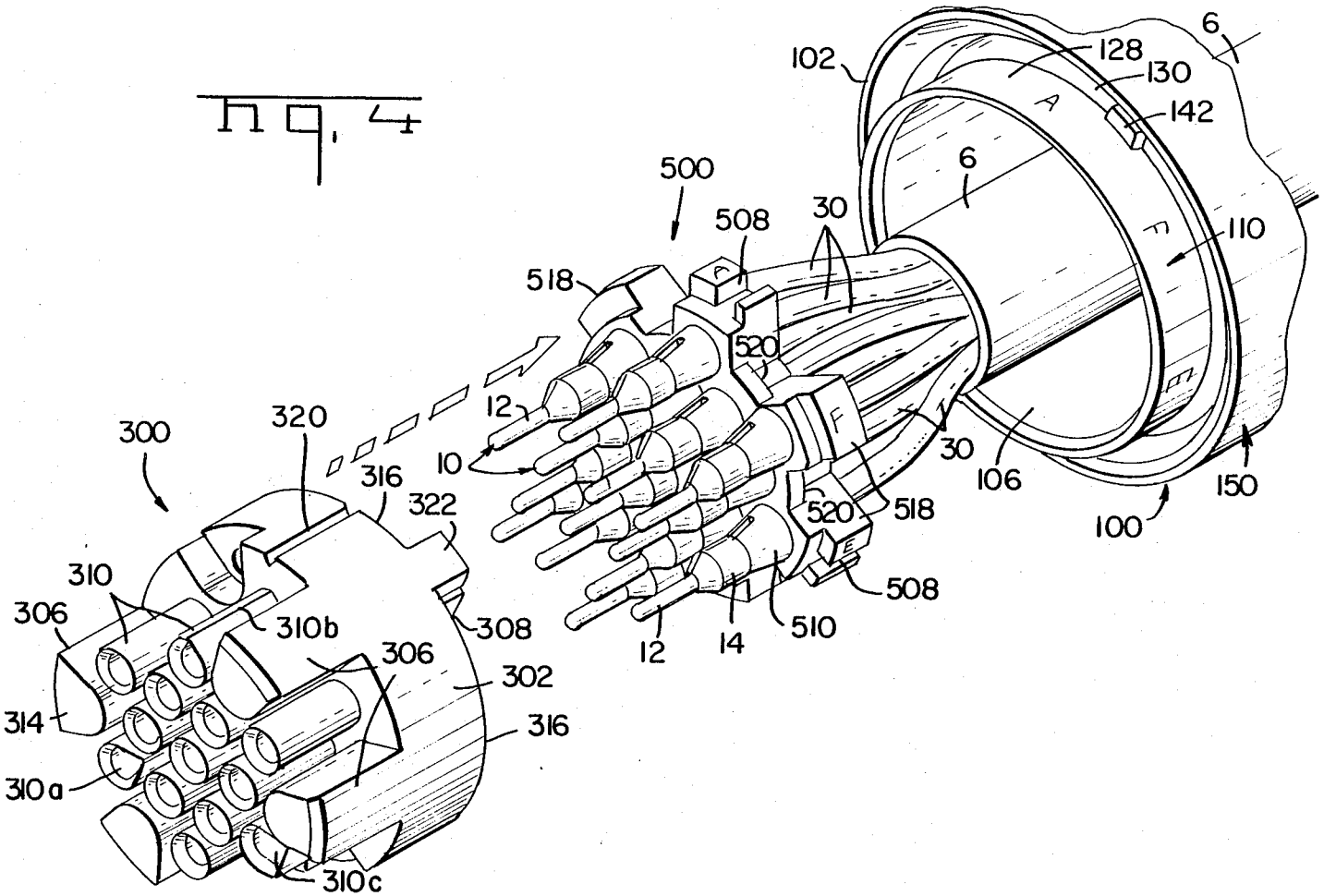
FIG. 7 is a sectional view of the assembled connector.

As shown in FIG. 1, the preferred embodiment of this invention comprises a first connector 2 attached to a second connector 4 for interconnecting the conductors in a first cable 6 to conductors in a second cable 8. Normally, the conductors in each cable would be identifiable by conventional means such as color coding. The conductors in the first cable 6 are arranged in a first ordered array which corresponds to the ordered array of the conductors in the second cable 8. Connector 2 is matable to connector 4. In FIG. 2, the mating ends of connectors 2 and 4 are illustrated.

The embodiment of FIGS. 1 and 2 includes first and second connectors each having an outer housing, such as outer housing shell 100 and hollow cylindrical member 200, which are mutually engageable upon mating. Inner bodies alternately insertable in the outer housing shell 100 and the hollow cylindrical member 200 contain contact terminals 10 and 20. These terminals or contacts are attached to the separate conductors 30 in the first and second ordered array, such as first cable 6 and second cable 8. When properly oriented and connectors are mated, with both the outer housing and the inner bodies being independently matable, the conductors in the first ordered array are properly attached to the conductors in the second ordered array. The terminals used in the preferred embodiment of this invention comprise conventional pin and socket terminals of the type disclosed in U.S. Pat. No. 4,544,220, incorporated herein by reference.

The stamped and formed pin contact terminals 10 include a forward mating pin section 12 and a rear conductor engagement portion consisting of two enlarged sections 14 on opposite sides of a reduced section 16. A wire crimp 18 is located at the rear of the pin contact terminal 10. Socket contact terminals 20 are similarly stamped and formed with a socket portion 22 suitable for mating with pin contact portion 12 at the forward mating end. Enlarged sections 24 surround a reduced section 26 to also form a contact retention portion with a crimp 28 located at the rear of the terminal. Pin terminals 10 and socket terminals 20 are interchangably insertable in mating connector housings.

FIG. 3 is an exploded perspective view of the first connector 2 shown in FIG. 1. FIG. 3 illustrates the modular construction of this connector. FIG. 3 shows that alternate inner bodies, such as the post type contact holder 300 and rear contact holder 500 or a cavity type inner contact holder 400 mated to a rear contact holder 500, can be inserted into the bore of the outer housing shell 100. Similar interchangability is possible with hollow cylindrical member 200.

Figure 6A:
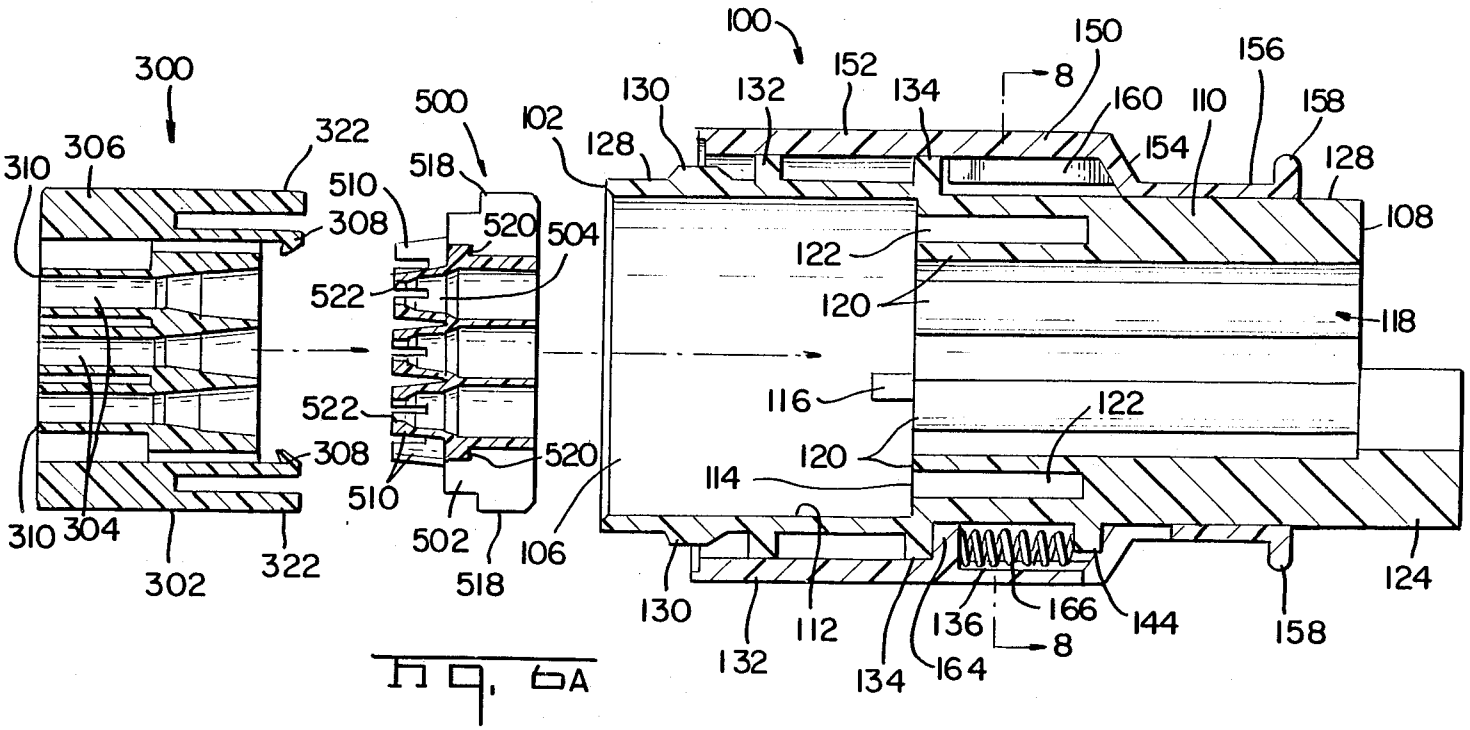
FIG. 6A is an exploded sectional view taken along section lines 8—8 showing the housing components of one connector half.

As shown in FIG. 6A, the outer housing shell 100 has a front end 102 and a rear end 108. Bore 106 extends through the hollow housing shell. The outer housing shell 100 consists of an inner housing core 110 and an outer sleeve 150, which is shiftable relative to the core 110. Both the housing core 110 and the shiftable sleeve 150 are molded of an insulative plastic such as Valox. Valox is a trademark of General Electric Company, and is a conventional material used for electrical connector housings. The front portion of the housing core 110 comprises a cylindrical seat 112 suitable for receiving the inner bodies in a manner which will be described subsequently. An inner shoulder 114 separates the front cylindrical seat 112 from the cable entry portion 118. Raised interfitting keying bosses 116, one of which is shown in FIG. 6A, form the tongue of a tongue and groove interconnecting means, and are located in the cylindrical seat 112 extending forward from shoulder 114. A plurality of tubular extensions 120, each having a hole 122 suitable for receipt of a screw, are located in the cable entry portion 118 and extend rearwardly from the shoulder 114. As shown more clearly in FIG. 8, these tubular extensions 120 project inwardly from the inner periphery of the cable entry portion 118. In the preferred embodiment of this invention, six equally spaced tubular extensions 120 are located in the cable entry portion. A semi-cylindrical strain relief ledge 124 is located at the rear of the housing core 110.

The outer surface 128 of the housing core 110 has a cylindrical ridge extending around the entire periphery of the housing core 110. Ridge 130 is spaced from but adjacent to the leading edge 102. A stabilizing rib 132 extending radially beyond the ridge 130 is spaced rearwardly from ridge 130 and has a flat outer edge of constant diameter. A cylindrical stop shoulder 134 is rearwardly spaced from stabilizing rib 132 and also has a flat outer surface of the same outer diameter as the stabilizing rib 132. One of several spring cavities 136 extends between the cylindrical stop shoulder 134 and a rearwardly spaced rear spring stop which also consists of one of a series of ribs 144 extending around the housing core 110. The housing core 110 also includes an anti-rotation tab 138 and an anti-rotation stop 140, both shown in FIG. 8. Anti-rotation tab 138 consists of a member having an outer cylindrical surface 137 and a flat stop surface 139. Anti-rotation tab 138 extends outwardly from the outer periphery of the housing core 110 rearwardly of the stop shoulder 134, as shown in FIG. 6. Anti-rotation stop 140 also protrudes from the outer periphery of the housing core 110 in the vicinity of the anti-rotation tab 138.

A raised key comprising a first key protrusion 142 is located along the cylindrical ridge 130 and is best shown in FIG. 2. Only one raised keying surface 142 is shown in FIG. 2, but it should be understood that a second similar keying surface would be obscured in the view shown in FIG. 2. In the preferred embodiment, these raised keying protrusions 142 would be asymmetrically spaced on the outer periphery of housing core 110 along ridge 130.

Figure 8:
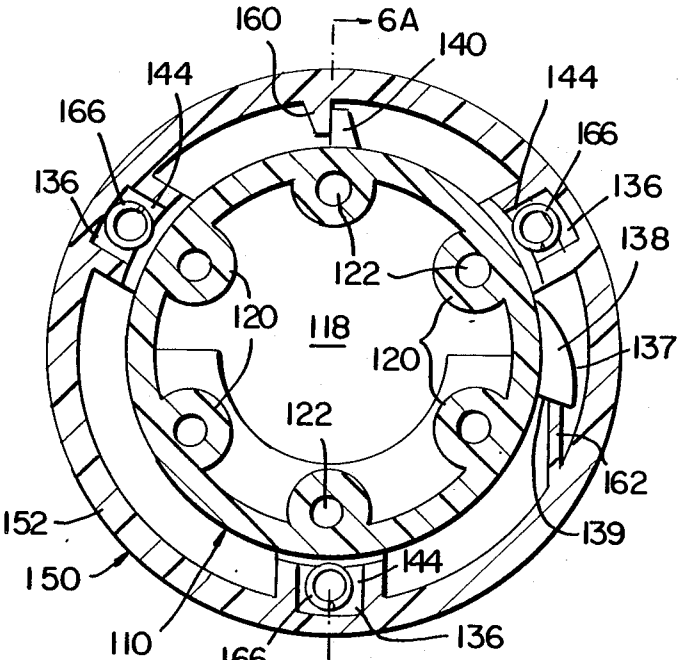
FIG. 8 is a cross-section taken along section lines 8—8 in FIG. 6A.

A shiftable sleeve 150 surrounds housing core 110. The shiftable sleeve 150 has an enlarged front sleeve section 152, a inwardly sloping intermediate sleeve transition section 154, and a smaller rear sleeve section 156. A gripping collar consisting of a protruding lip 158 is located at the rear of and on the exterior of the smaller rear sleeve section 156. This outer shiftable sleeve 150 telescopingly surrounds the periphery of the housing core 110 with the inner periphery of the shiftable sleeve 150 slidably engaging the outer edges of stabilizing rib 132 and cylindrical stop shoulder 134. Outer sleeve 150 can be shifted axially relative to the housing core 110. Rotation of the outer sleeve 150 relative to the housing core 110 is prevented by sleeve anti-rotation stop 160 and a deflectable anti-rotation tab 162. As shown in FIG. 8, the sleeve anti-rotation stop engages the anti-rotation stop 140 on the housing core 110 while the deflectable anti-rotation tab 162 engages the flat surface 139 on the anti-rotation tab 138 which extends outwardly from the inner housing core 110.

A spring 166 is located within each spring cavity 136 on the exterior of the housing core 110. In the preferred embodiment of this invention, three springs 166 are disposed between housing core 110 and shiftable sleeve 150 at discrete angular positions. The opposite ends of each spring 166 engage the sleeve spring stop 164 which comprises a cylindrical rib extending inwardly on the inner periphery of the shiftable sleeve 150 at the forward end and engages an outwardly projecting rear spring stop 144 on the housing core 110. Thus, rearward movement of the spring 150 on the housing core 110 would be resisted by the spring 166 which would be placed in compression. A plurality of spring access holes 168 are located along the sleeve transition section 154 and are each in alignment with one of a plurality of springs 166 located between the housing core 110 and the shiftable sleeve 150.

The outer housing shell 100 can be assembled by first inserting the sleeve 150 over the housing core 110 with the spring 166 located in the spring cavities 136. Housing core 110 is inserted into the shiftable sleeve from the front, with the rear spring stop 144, which comprises a plurality of separate protrusions, which do not extend around the entire periphery of the housing core 110. Spring stops 144 are not in alignment with the springs 166 when initially inserted. The inner housing core can then be rotated, in the counter clockwise direction with reference to FIG. 8. Springs 136 can be compressed with a suitable tool extending through access holes 168 during rotation of the inner core 110. Continued rotation of inner core 110 moves the deflectable tab 162 along the cylindrical surface 136 until the deflectable tab 162 engages the flat surface 139. Stop 140 engages stop 160 at this point and the rear spring stops 144 are moved behind the springs 166.

Figure 6B:
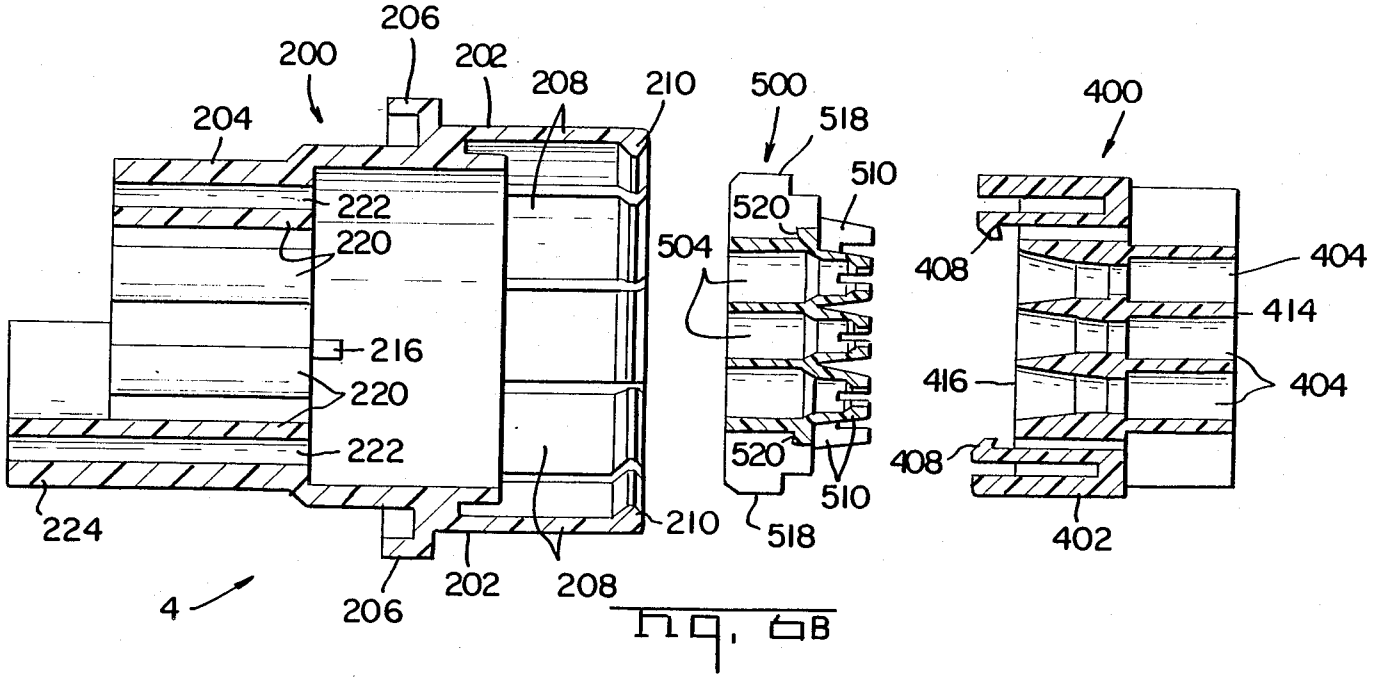
FIG. 6B is an exploded sectional view showing the housing components of the other connector half.
Figure 7:
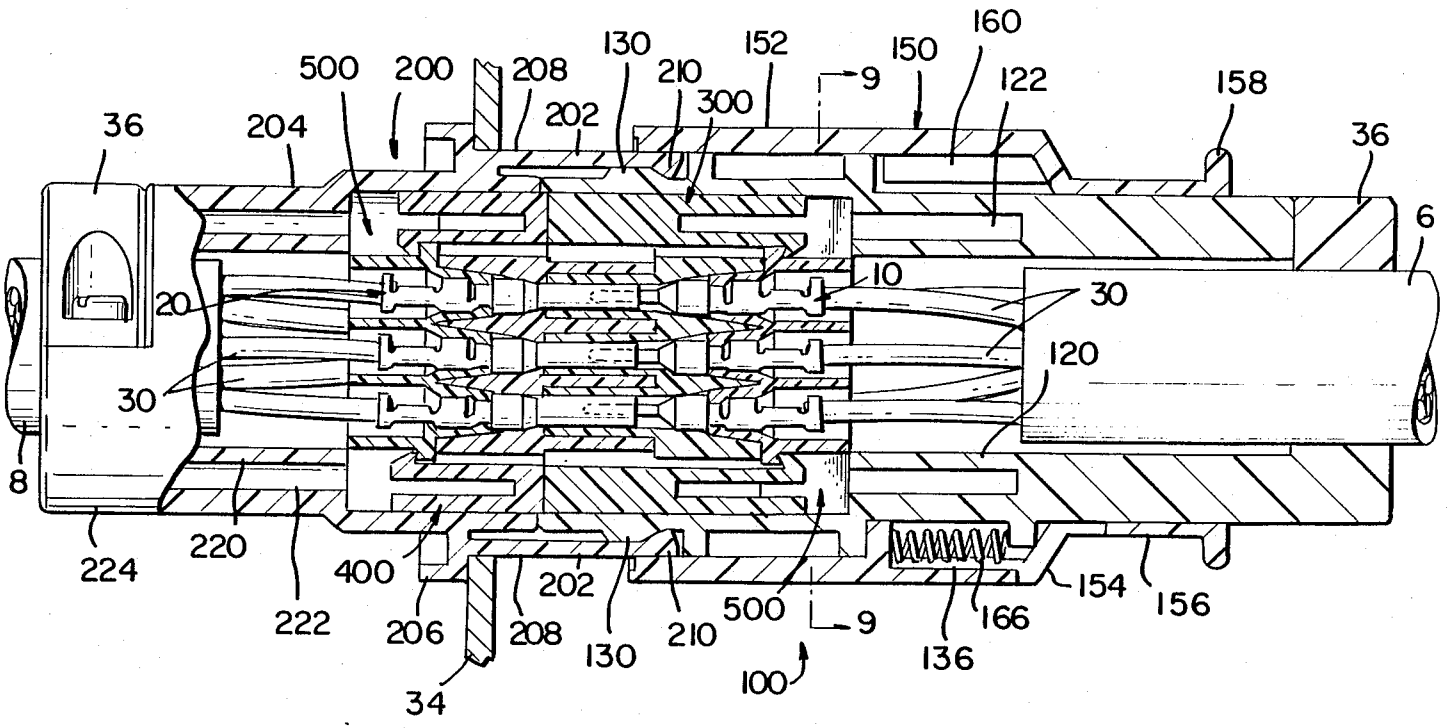
Figure 7:
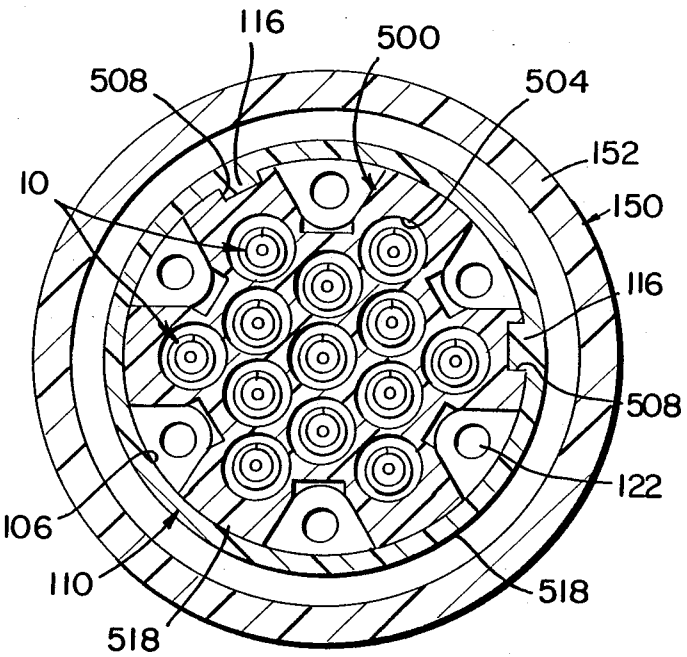

As shown in FIG. 6B, the hollow cylindrical member 200 is matable with the outer housing shell 100 and has a plurality of separate resilient collet fingers 202 extending from the front edge of the cylindrical member. The hollow cylindrical member 200 and the collet fingers 202 comprise integrally molded plastic members. The hollow cylindrical member 200 can be formed from a suitable engineering plastic such as Valox, commonly used for electrical connector housings. Hollow cylindrical member 200 has a cylindrical barrel 204 extending rearwardly from an intermediate mating flange 206. The collet fingers 202 extend forwardly from the intermediate mounting flange 206 and each collet finger comprises a cantilevered collet arm 208 with an enlarged collet head 210 located at the free end of each collet arm 208. The collet fingers 202 are discontinuously and asymmetrically disposed around the periphery of the hollow cylindrical member 200 and, in the preferred embodiment of this invention, adjacent collet fingers 202 at two separate locations are spaced apart to define slots which comprise first key slot or keyway 212 and second key slot or keyway 214.

Alignment keying bosses 216 are asymmetrically located on the interior of the hollow cylindrical member and comprise raised surfaces extending from an interior shoulder. A plurality of tubular extensions 220 extend from this shoulder rearwardly within the rear cable retention barrel 204. Each tubular extension 220 has a screw hole and the tubular extensions 220 are disposed around the interior of the cable retention barrel 204 in the same manner as tubular extensions 120 are disposed around the cable portion 118 of outer housing shell 100. The orientation of the tubular extensions 220 relative to the alignment keying boss 216 in the hollow cylindrical member 200 is the same as the orientation of the tubular extensions 120 relative to the interfitting alignment keying boss 116 of outer housing shell 100. A strain relief ledge 224 is located at the rear of the cable retention barrel 204 and the inner periphery of the strain relief ledge 224 merges with the inner periphery of the cable retention barrel 204. Hollow cylindrical member 200 can be mounted on a panel 34 by bolts extending through holes 218 located on the mounting flange 206 in a conventional manner. Inner bodies consisting of either a post type contact holder 300 or a cavity type contact holder 400, either of which can be attached to an appropriate rear contact holder 500, can be received within either the outer housing shell 100 or the hollow cylindrical member 200. These inner body members can be formed of the same insulative plastic as used for the outer housings.

Post type contact holder 300 is matable with cavity type contact holder 400. The post type contact holder 300 comprises an integrally molded member having a post contact holder base 302 with a plurality of first passages 304 extending through the base 302. A plurality of pillars 306, each being similarly shaped, extends upwardly from the periphery of the base 302. Latches 308 extend rearwardly from the back of the base 302. A plurality of posts 310, through which passages 304 extend, extend forwardly from base 302. These posts 310 are arranged in a pattern on the exterior of the post type contact holder 300. The majority of the posts 310 comprise posts **310*d* having a circular outer cross-section. At least one of these posts, however, has a distinct cross-section. In the preferred embodiment of this invention, one contact post 310*a* has a tear drop cross-section. Another contact post 310*b* has a truncated tear drop cross-section, having a flattened rather than a sharp point. A third contact post 310*c* has a flat profile along one edge. In the preferred embodiment of this invention, these three distinctly shaped posts 310*a*, 310*b* and 310*c*, are distinctly located within the pattern of posts in the post type contact holder 300. Posts 310 extend from the front face 314 and extend parallel to the pillars 306. The cross-section of each individual pillar and each individual post is constant from the base 302 to the front face 314. Passages 304 extend from the free ends of posts 310 through the base 302 to the rear face 316. A plurality of screw holes 318 are located in the base 302. In the preferred embodiment of this invention depicted herein, two screw holes, diametrically opposed, extend through base 302. A score line 320 is defined in the outer periphery of the base 302 and the pattern of posts 310 is uniquely oriented relative to this score line. The latches 308 are resiliently deflectable and are each backed up by an adjacent over-stress arm 322 also extending rearwardly from the rear face 316 of base 302**.

The cavity type contact holder 400 also has a cavity holder base 402. A plurality of passages 404 extends through the base 402 and into a cavity section 406 formed on the front of the base 402. This cavity section has a plurality of cavities 410 extending inwardly from the front face 414 of the cavity holder 400. The cavities 410 merely comprise extensions of the passages 404. The cavities 410 are positioned within a unique pattern in the same manner as on the post type contact holder 300. In the preferred embodiment of this invention, the majority of the cavities **410*d* have a circular cross-section. However, as with the post type contact holder, at least one of the posts would have a distinct cross-section. In the preferred embodiment of this invention, one post 410*a* has a tear drop cross-section, another post 410*b* has a truncated tear drop cross-section, and a third cavity has a flat profiled cross-section 410*c*. The majority of the cavities 410*d* have the same standard cross-section, such as the circular cross-section depicted herein. The cavities 410*a*, 410*b*, and 410*c* are uniquely disposed within the pattern of cavities 410 and the disposition of cavities 410*a*, 410*b*, and 410*c* corresponds to the disposition of posts 310*a*, 310*b*, and 310*c*, forming a mirror image thereof. Cavities 410 are dimensioned to receive posts 310**.

Latches 408, similar to latches 308, extend from a rear face 416 of the contact holder base. A plurality of screw holes 418, extend through the base 402. As with the mounting holes 318 in post type contact holder 300, the mounting holes 418, in the preferred embodiment of the cavity type contact holder 400 depicted herein, are diametrically opposed and have the same relationship relative to the pattern of cavities 410. Furthermore, channels 406 on the exterior of the cavity type contact holder are configured to receive pillars 306 on the post type contact holder. A score line 420 is located on the periphery of the cavity type contact holder 400 and has a unique orientation relative to the pattern of cavities 410 and to the cavities having unique cross-sections. In the preferred embodiment of this invention, the score line 420 is oriented relative to the pattern of cavities 410 in the same manner as the score line 320 would be oriented relative to the pattern of posts 310. Thus, by merely aligning score line 420 with score line 320, the cavity type contact holder 400 could be mated with the post type contact holder 300. The unique pattern of cross-sections for cavities **410*a*, 410*b*, and 410*c*, which correspond to the unique pattern of post cross-sections 310*a*, 310*b*, and 310*c*,** form a second keying means for engaging complementary inner bodies of the two connectors in only one angular orientation.

The rear contact holder 500 has a contact holder base 502 with a plurality of passages 504 configured to mate with either passages 404 in cavity type contact holder 400 or passages 304 in post type contact holder 300. The rear contact holder 500 is configured to mate with either the post type contact holder 300 or the cavity type contact holder 400 in a plurality of specified angular orientation. A plurality of radial platforms 518 extend outwardly from the inner portion of the rear contact holder base 502. On two of these platforms 518, an interfitting groove, which forms half of a tongue and groove means for engagement with the interior of an outer housing member, is located. These interfitting grooves 508 are configured to mate with either the alignment keying bosses 116 or the alignment keying bosses 216 to form a tongue and groove retaining means. Thus, the rear contact holder 500 can be positioned relative to the outer housing member in only one angular orientation. In the preferred embodiment of this invention, separate rear contact holders 500 are employed for the outer housing shell 100 and the hollow cylindrical member 200. The precise angular orientation of grooves 508 differs slightly to correspond with the different angular positions of alignment bosses 116 and 216.

A plurality of flexible contact retainers 510 extend forwardly from the rear contact holder base. These contact retainers are configured similarly to the contact retainers disclosed in U.S. Pat. No. 4,544,220, incorporated herein by reference. Each of the contact retainers 510 extends around the appropriate contact terminal and an enlarged forward end can be received within the reduced section 16 or 26 on the pin type contact terminal 10 or the socket type contact terminal 20 respectively. Contact retainers 510 can then be received within the passages 304 or 404 at the rear of bases 302 or 402 respectively. Latches 308 and 408 are insertable within latch relief sections 520 between radially extending platforms 518. Since a plurality of latch relief sections 520 are formed around the periphery of the contact holder 500, either the post type contact holder 300 or the cavity type contact holder 400 can be assembled to the rear contact holder 500 in a plurality of specified angular orientations. Indicia on radial platforms 518 in the form of letters can be aligned with a reference, such as the score line on either the post type contact holder 300 or the cavity type contact holder 400, to determine the prescribed orientation of post or cavity patterns relative to the rear cavity holder 500 and thus relative to the outer cylindrical housing member. In the preferred embodiment of this invention, a distinct indicia, such as separate letters, correspond to each of the separate possible orientations.

Assembly of the First Embodiment

Figure 5:
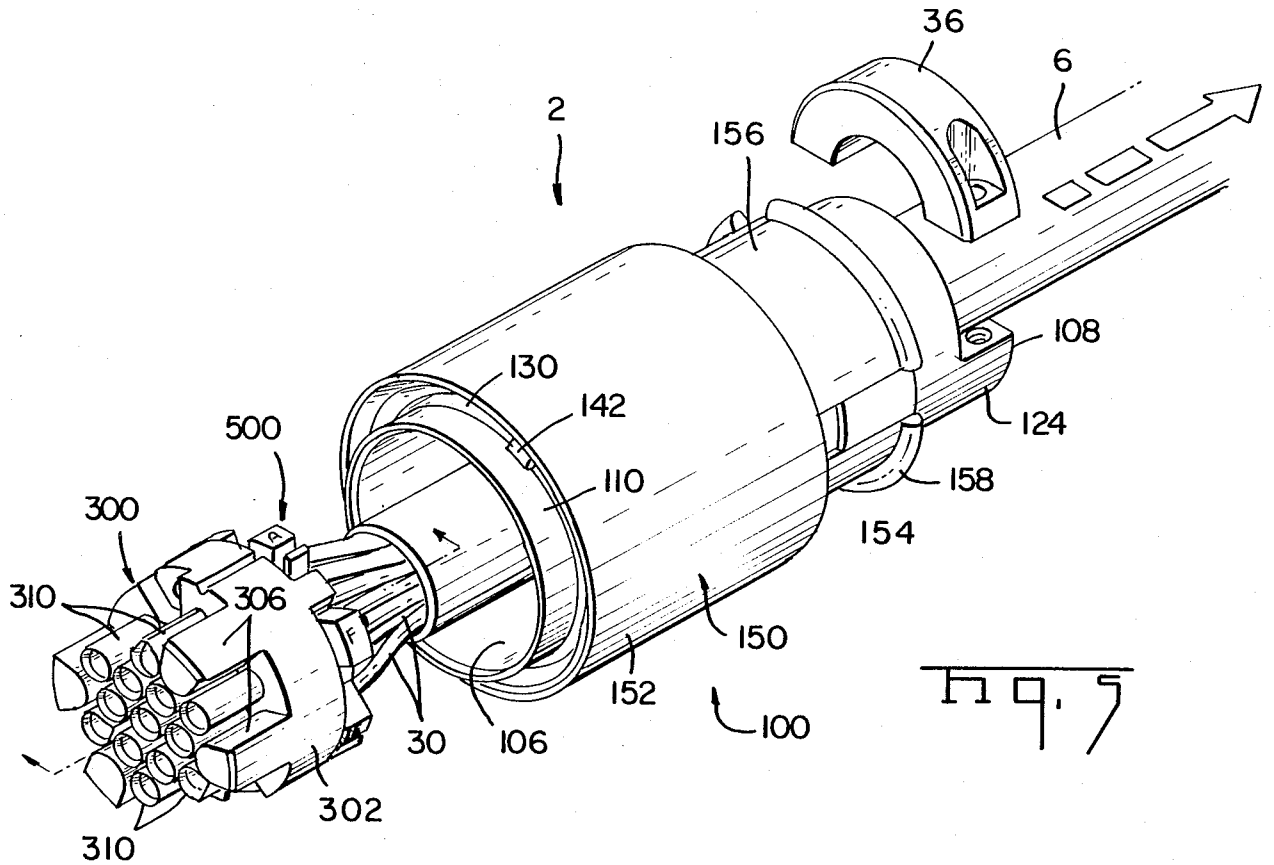
FIG. 5 is a view similar to FIG. 4 showing a final assembly operation.

FIGS. 3–5 show the manner in which a plurality of conductors 30, such as separate insulated wires, can be terminated in the preferred embodiment of this invention. Initially, the outer cable cover should be stripped back from the end of the wires to expose the individual insulated conductors. The ends of the conductors should then be stripped in a conventional manner and each should be terminated to a standard pin terminal 10 or to a standard socket terminal 20. The cable should then be inserted through the outer housing member, such as the outer housing shell 100 or the hollow cylindrical member 200. FIGS. 3–5 show the assembly of the connector employing the outer housing shell 100, but it should be understood that assembly for the other connector half employing hollow cylindrical member 200 would be similar.

After the terminated conductors have been inserted through the outer housing, the individual terminals can then be affixed to the rear contact holder 500 by inserting each terminal through the contact retaining fingers 510, as shown in FIG. 4. These contact retaining fingers 510 engage either the pin type contact terminal 10 or the socket type contact terminal 20 in the manner depicted in U.S. Pat. No. 4,544,220. The bulged section 522, shown in FIGS. 6A and 6B, at the free end of each contact retainer 510 fits within the reduced section 16 or 26 of the pin terminal 10 or the socket terminal 20, respectively, to firmly seat each individual terminal in the rear contact holder 500. Terminals inserted in each contact holder can be all pin terminals 10 or all socket terminals 20. A mixture of pins 10 and sockets 20 can be inserted in contact holder 500 as long as a complementary arrangement is employed in the mating connector. In the preferred embodiment of this invention, a precise orientation or circuit pattern of the individual conductors 30 can be maintained. Each individual passage 504 in the rear contact holder 500 can be numbered on the rear face 516 of the base 502. Since the rear contact holder can be positioned on the outer housing body in only one position, the pattern of conductors 30 can thus be uniquely and constantly oriented with respect to the outer housing element. In many applications, the pattern of conductors must be oriented in the same configuration with respect to an external reference, thus necessitating that rear contact holder 500 must be similarly oriented. For example, a first numbered connector might always need to be in the upper left hand position. Alternatively, the individual conductors can be arbitrarily inserted into the housing cavities and it is not necessary that the same circuit pattern be maintained with respect to the rear contact holder 500 or with respect to the connector itself.

With the individual terminals firmly seated in the rear contact holder, the rear contact holder 500 can be assembled either to the forward post type contact holder 300 or the forward cavity type contact holder 400. The score line 320 can be aligned with the appropriate indicia 512 on the rear contact holder 500. Latches 308 are insertable between the radial platforms 518 when the score line is appropriately aligned. The pattern of posts or cavities can be aligned relative to the rear contact holder 500, and therefore relative to the pattern of conductors 30 in one of the several discrete orientations. The pattern of cavities or posts are aligned in the desired manner by ensuring that the posts 310*a*, 310*b*, 310*c* or the cavities 410*a*, 410*b*, 410*c* with distinct cross-sections are uniquely oriented relative to both the contact holder 500 and the pattern of conductors 30.

With the front and rear contact holder assembly firmly attached, the cable is now withdrawn into the outer housing element as shown in FIG. 5. The grooves 508 on the rear contact holder 500 must be appropriately aligned with a companion tongue, such as the interfitting alignment keying boss or tongue 116 on the interior of the outer housing member 100 shown in FIG. 6. Upon complete engagement of this tongue and groove key, the rear contact holder 500 will have a precise orientation relative to the outer housing member. However, since the front contact holder can be oriented relative to the inner housing member 500 in a number of distinct orientations, the orientation of the inner housing assembly, as defined by the orientation of the distinct posts 310*a*, 310*b*, 310*c* or cavities 410*a*, 410*b*, 410*c* relative to the outer housing member, would thus be in any number of distinct orientations. The inner housing assembly can now be attached to the outer housing member by inserting screws through screw holes aligned in the front and rear contact holders and into the screw holes 122 of the housing core 110. When completely assembled to the outer housing shell 100, the front face 314 of the post type contact holder 300 or the front face 414 of the cavity type contact holder 400 will be behind the front face. When assembled to the hollow cylindrical member 200, the front face will be flush. After the inner body has been assembled to the outer body, a strain relief cap 36 can be assembled to the strain relief ledge 224 of the hollow cylindrical member 200 or to the strain relief ledge 124 of the outer housing shell 100.

To mate two connectors, one with a post type contact holder 300 and the other with a mating cavity type contact holder 400, the outer keys comprising the raised keys 142 are aligned with the corresponding keyslots 212 in the mating outer housing members. If matable connectors have been chosen, the post and cavity patterns on the inner housing members will correspond. In this manner, the outer housing members are independently matable and the inner housing members are independently matable so that corresponding connectors can be mated. If, however, the pattern of posts or cavities do not correspond, the two connectors cannot be mated.

Assuming matable connectors have been chosen, the connectors will latch in the manner shown in FIGS. 13A–13E. The collet fingers 202 will be cammed outwardly upon engagement with the cylindrical ridge 130. Continued movement of the mating outer housing shells will bring the free end of collet fingers 208 into engagement with the free end of shiftable sleeve 150. When the collet head 210 is moved beyond the ridge 130, springs 166 will urge sleeve 150 back over the collet fingers 202 firmly trapping collet heads 210 behind ridge 130. Sleeve 150 is then shifted into place over the collet fingers 202 by springs 166 to securely trap the collet fingers 202 and to securely latch the two connectors together. The collet head 210 and ridge 130 have sloped mating surfaces to produce an inertial effect during engagement. The flexure of the collet fingers and the shifting of sleeve 150 results in an audible snap upon mating. The two housings cannot be disengaged simply by pulling on the two cables. However, if the shiftable sleeve 150 is first moved backward, an extraction force placed upon the connector will allow the collets 208 to resiliently flex in the outward direction thus disengaging the collet head 210 from the ridge 130 to disconnect the two connectors.

Second Embodiment

Figure 10:
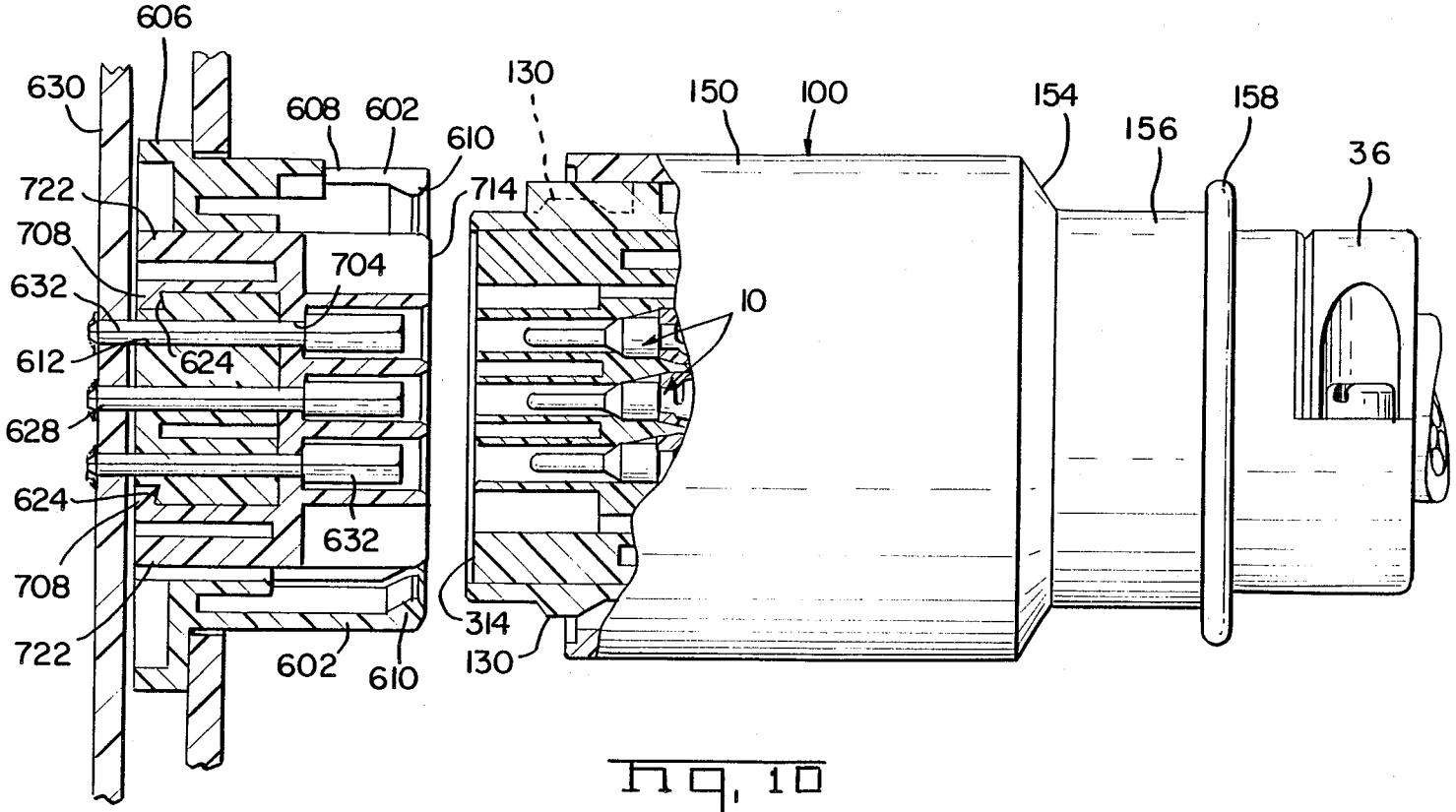
FIG. 10 is a view partially in section of an alternate embodiment of this invention suitable for use with printed circuit boards.
Figure 11:
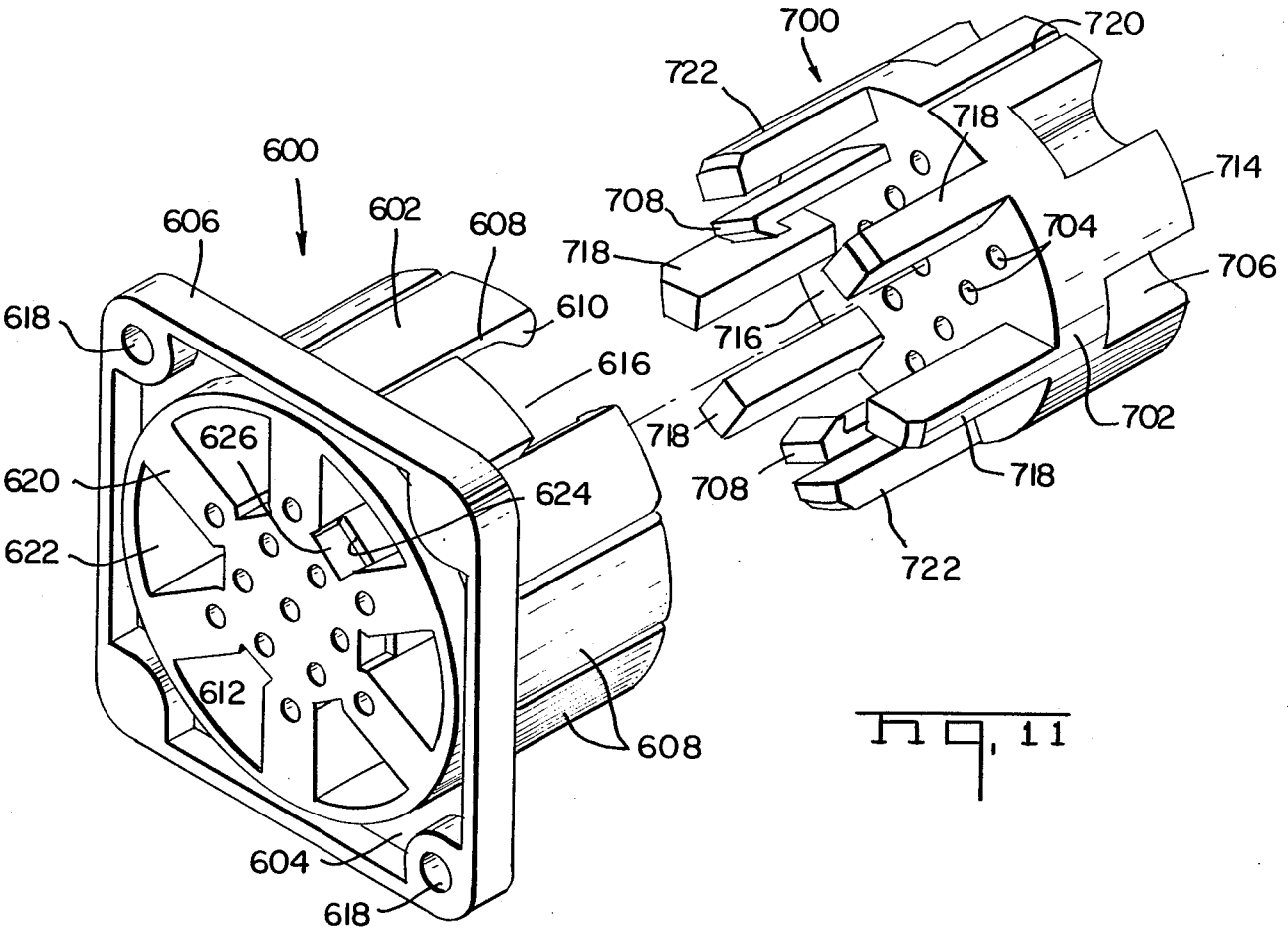
FIG. 11 is an exploded perspective view of one connector in the embodiment of FIG. 10.
Figure 12:
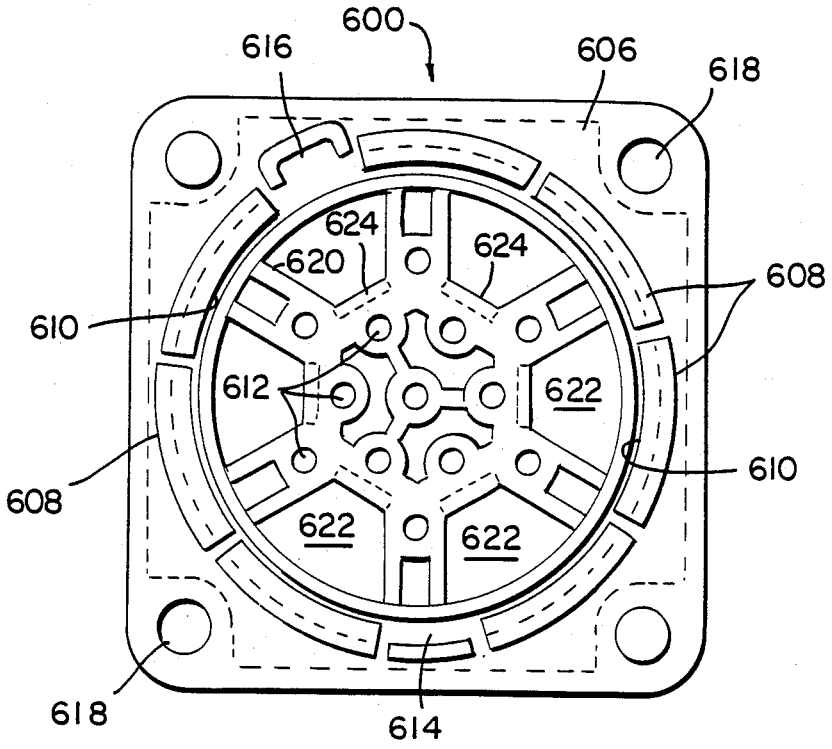
FIG. 12 is a front view of the outer housing member of the embodiment of FIG. 10.
Figure 17A:
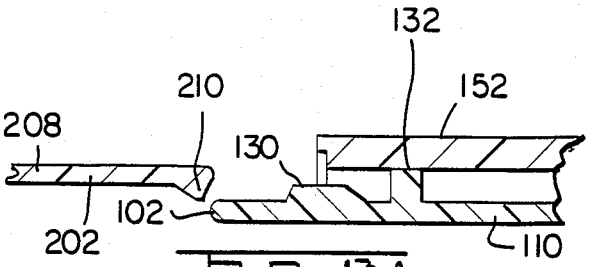
Figure 17B:
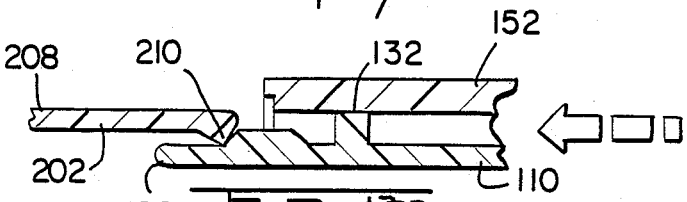
Figure 17C:
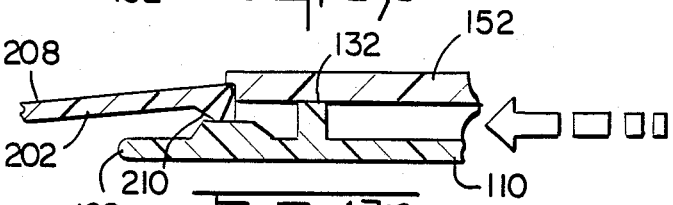
Figure 17D:
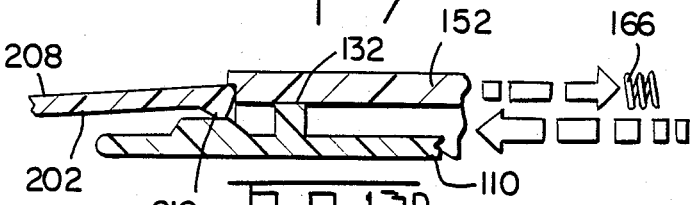
Figure 17E:
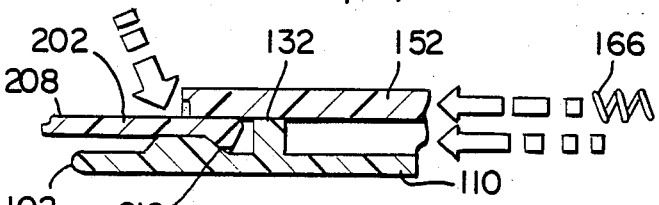

FIGS. 10, 11 and 12 show an alternate embodiment of one of the two connectors forming a connector assembly of this invention. Connector 600 is adapted for use with a printed circuit board rather than for use with a plurality of individual insulated wires. The outer housing of connector 600 consists of a base 604 with a plurality of collet fingers 602 extending from one side of the base. The collet fingers 602 are disposed in a cylindrical configuration with each collet finger having a collet arm 608 and a collet head 610. A mounting flange 606 is formed on the exterior of the base 604 with a plurality of holes 618 suitable for receiving mounting screws disposed at the corners of the mounting flange 606. A plurality of terminal receiving holes 612 extend through the center of base 604 and a plurality of radial arm segments 620 extend outwardly from the center of base 604 toward the periphery of flange 606. These radial arms or segments 620 are spaced apart and form a plurality of pie shaped segments or openings 622. A latch shoulder 624 and a latch relief 626 is formed on the central portion of base 604 at the apex of each segment 622. Sockets 632, suitable for attachment to a printed circuit board 630, can be received within the holes 612 in an ordered configuration.

An inner body member 700, suitable for receiving sockets 632, can be positioned within the outer printed circuit board housing member 600. Member 700 has a base 702 with a plurality of passages 704 extending from the front to the rear of base 702. The forward end of base 702 has a plurality of cavities whose configuration conforms to that of a cavity type contact holder 400 used for discrete wires. Therefore, the inner body 700 would be matable with a post type contact holder 300. It should be understood that a board post type inner body member could be substituted for cavity type inner body member 700 in the same manner that post and cavity contact holders can be interchanged for the discrete wire connector.

A plurality of latching arms 708 extend from the rear face 716 of the base 702. Each latching arm 708 is located adjacent an overstress arm 722. Each latching arm 708 can be deflected outwardly and the overstress arm 722 limits deformation of the latching arm 708. In the preferred version of this alternate embodiment, two oppositely positioned latching arms 708 are employed. A plurality of stabilizing arms 718 extend parallel to latches 708 and are equally spaced around the periphery of the board inner body member 700. The inner body member 700 can be attached within the outer housing 600 by aligning latches 708 and stabilizing arms 718 with segments 622 When the inner body member 700 is inserted within this outer housing, latches 708 are deflected outwardly by the center portion of the base 604. Upon complete insertion, the latches 708 are free to deflect inwardly to enter the latch relief 626 and engage the latch shoulder 624 on base 604. In this position, the passages 704 will be aligned with the terminal holes 612 and the pin section 628 of sockets 632 will extend through aligned passages. Proper alignment can be achieved by aligning score line 720 with appropriate indicia on the exterior of the collet fingers 602 in the same manner as for the discrete wire connectors. With the outer housing 600 and the inner body 700 attached in this manner, the pin sections of sockets 632 can be inserted into appropriate holes on a printed circuit board and an electrical connection can be made to the printed circuit board in a conventional fashion. A matable connector consisting of an outer housing shell 100 and a matable inner contact holder containing a corresponding post type contact holder 300 or cavity type contact holder 400, can then be attached to the connector consisting of the outer body 600 and the inner body 700. Outer body 600 has keyslots 614 and 616 between adjacent collets in the same fashion as previously discussed with respect to the hollow cylindrical member 200.

Circuit Interconnection

Figure 14:
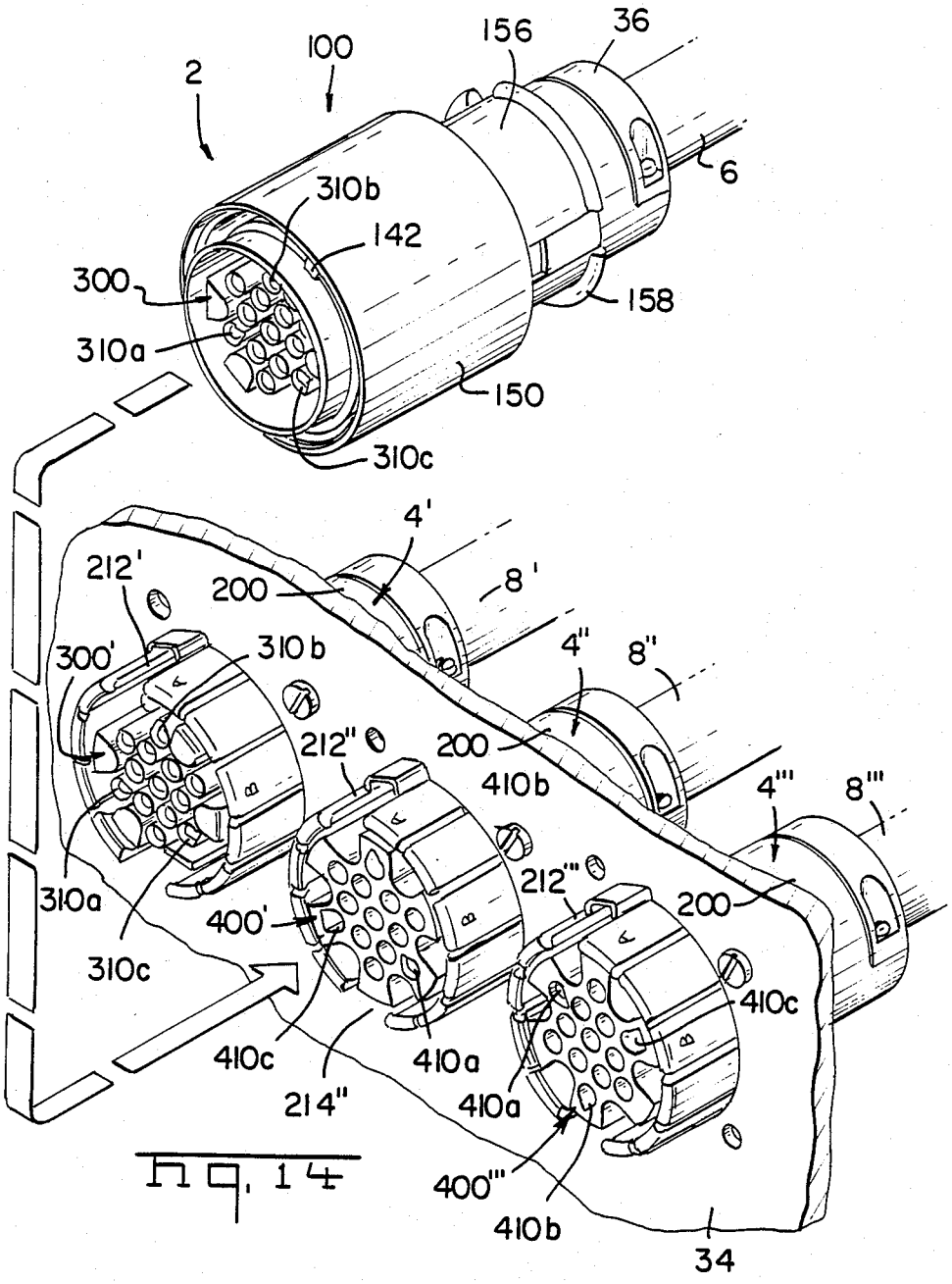
FIG. 14 is a perspective view demonstrating that one connector half can only be intermated with the other connector half having the same respective angular orientation of the elements therein.

FIG. 14 discloses the manner in which the interchangeable parts employed to assemble this connector can be used to discriminate between keyed mating connectors. A first connector 2 consists of an outer housing shell 100 with a post type inner body contact holder 300. Three second connectors, 4', 4'', and 4''' are shown mounted within a panel 34. Each of the second connectors consists of a hollow cylindrical outer body 200 having collet fingers 202. Each of the connectors, 4', 4'', and 4''' has the hollow cylindrical member 200 positioned within panel 34 in the same orientation as evidenced by the position of keyslots 212', 212'' and 212'''.

Connector 4', however, has a post type contact holder 300. Even though the posts with unique cross-sections, **310*a*, 310*b*, 310*c*, are aligned in the same configuration relative to keyslot 212 as in the connector 2 shown in FIG. 14, the connector 2 and the connector 4'** are obviously not intermatable since each has post type inner bodies.

Connector 4'' employs a cavity type contact holder 400'. Examination of FIG. 14 will show that the cavities having unique cross-sections, **410*a*, 410*b*, 410*c*, are arranged with respect to keyslot 212'' in the same manner as the posts 310*a*, 310*b* and 310*c* in connector 2. Thus, the key 142 on connector 2 in FIG. 14 can be aligned with keyslots 212'' on connector 4''** and the connectors can be intermated as shown by the arrow.

The third connector 4''' also employs a cavity type contact holder 400'''. However, the orientation of the cavities having unique cross-sections, **410*a*, 410*b*, 410*c*, with respect to the keyslot 212''' differs from the orientation of the mating posts relative to key 142** in the connector 2. Therefore, connector 2 could not be mated with connector 4'''.

This connector assembly therefore permits discrimination between connectors so that only properly configured first and second connectors can be intermated, thus assuring that only corresponding circuits are interconnected. Furthermore, these distinct connectors can be configured from interchangeable parts which give a large number of options. Thus, conductors in an ordered array can be interconnected. Furthermore, it is not necessary to alter the orientation of the conductors themselves in order to achieve distinct polarization of the connectors. For instance, the conductor orientation in cables 8', 8'' and 8''' can be the same. However, only properly polarized connectors on corresponding cables could be mated.

The preferred embodiments of this invention demonstrate specific configurations for achieving these objectives. Other configurations could employ different geometries which would nevertheless incorporate the subject matter of the following claims.

What is claimed:

1. A modular electrical connector assembly for interconnecting a plurality of conductors in a first ordered array with a like plurality of conductors in a second correspondingly ordered array, the assembly comprising matable first and second connectors, each connector containing a plurality of terminals attachable to the conductors, and a connector housing, each housing comprising:

an outer housing shell, each shell being polarized by first keying means and matable with the outer housing shell of the other connector in only one mutual angular orientation;

an inner body, the terminals being mounted within the inner body, each inner body including second keying means for engaging with a complementary inner body in the other connector in only one angular orientation, and third keying means for orienting the inner body relative to the corresponding shell in one of a plurality of specified angular orientations, the mutual orientation between the first and second keying means in each corresponding inner body and shell being different in each specified orientation of the inner body relative to the shell, the first and second keying means being both engagable with complementary first and second keying means on the matable connector when the angular orientation between the inner body and the shell in the first connector corresponds to the angular orientation of the inner body relative to the shell in the second connector; and latching means on the first and second connector comprising a plurality of resilient collet fingers having enlarged ends on the outer housing shell of one connector, the other connector having a ridge on the outer housing shell and an outer shiftable sleeve, the collet fingers being deflectable over the ridge, the sleeve being shiftable over the collet fingers to retain the collet finger ends between the ridge and the sleeve;

whereby a plurality of distinct first and second connectors can be constructed from interchangeable outer housing shells and inner bodies, each distinct connector assembly being suitable for interconnecting conductors in a first ordered array only with conductors in a corresponding second ordered array.

2. The connector assembly of claim 1 wherein all of the terminals in the first connector are identical, all terminals in the second connector being identical, the terminals in the first connector being matable with the terminals in the second connector.

3. The connector assembly of claim 1 wherein each outer housing shell comprises a hollow cylindrical member and each inner body comprises a cylindrical member insertable within the outer housing shell.

4. The connector assembly of claim 1 wherein the inner body in the first connector has a plurality of separate posts extending from a front face thereof and the inner body of the second connector has a plurality of cavities extending inwardly from a front face thereof, posts being received within cavities upon mating the first connector to the second connector, terminals in the first connector being positioned within posts, terminals in the second connector being positioned within cavities.

5. The connector assembly of claim 4 wherein the second keying means on the inner bodies of the first and second connectors comprises at least one post and at least one cavity having complementary cross-sections different from the cross-sections of the remaining posts and cavities.

6. The connector assembly of claim 1 wherein the first keying means on one connector comprises a raised surface on the exterior of the front of the outer housing shell, the first keying means on the second connector comprises a slot on the second connector outer housing shell.

7. The connector assembly of claim 6 wherein the outer housing shell of the first connector further comprises a rear wall, the third keying means of the first connector comprising at least one depending latch on the inner body and a plurality of holes in the rear wall, each latch being insertable in each hole.

8. The connector assembly of claim 6 wherein the third keying means comprises interfitting tongue and groove means on the interior of the outer housing shell and on the periphery of the inner body.

9. The connector assembly of claim 7 wherein the inner body further comprises first and second members, the tongue and groove means interfitting the first inner body member to the outer housing shell, the second inner body member being attachable to the first inner body member in a plurality of specified angular orientations.

10. The connector assembly of claim 1 wherein the first keying means on one connector comprises a raised surface on the exterior of the front of the outer housing shell, the first keying means on the second connector comprises a slot between two adjacent collet fingers.

11. A modular electrical connector assembly for interconnecting a plurality of ordered first conductors in a distinctly oriented pattern to correspondingly ordered second conductors, the assembly comprising:

matable first and second connectors, each connector comprising a plurality of contact terminals and a multi-element insulative housing, each housing comprising an outer housing element and an inner housing element, each inner housing element including means for receiving contact terminals attached to the conductors, each housing including means for positioning the contact terminals in the inner housing element in the same distinctly oriented pattern as the first conductors;

each outer housing element being polarized relative to the mating outer housing element;

each inner housing element being separately and independently polarized relative to the mating inner housing element so that the first and second connectors are matable only when the angular orientation of both inner housings to the corresponding outer housing is the same, each inner housing element being attachable to the corresponding outer housing element in a plurality of angular orientations, and having passages therein alignable with contact terminals in the distinctly oriented pattern in each angular orientation, the means for receiving the terminals comprising a rear contact holder, the inner housing element further comprising a mating front contact holder, each front and rear contact holder being mutually attachable in a plurality of distinct orientations;

whereby a plurality of distinct first and second connectors can be assembled from interchangeable parts to intermate only with correspondingly configured connectors.

12. The modular electrical connector assembly of claim 11 wherein a plurality of collet fingers are discontinuously disposed around the front of a first outer housing element to polarize the first outer housing element.

13. The modular electrical connector assembly of claim 11 wherein the inner housing elements are polarized to intermate with complementary inner housing elements in only one angular orientation.

14. The modular electrical connector assembly of claim 13 wherein the outer housing elements are polarized to intermate with complementary outer housing elements in only one angular orientation.

15. A modular electrical connector assembly for interconnecting a plurality of conductors in a first ordered array with a like plurality of conductors in a second correspondingly ordered array, the assembly comprising matable first and second connectors;

the first connector comprising:

a hollow housing shell having a front end and a rear end and a first key on the front end;

a first inner body fitting within the hollow housing shell and having a plurality of first passages extending between a front face and a rear face of the first inner body, the first passages being arranged in a pattern having a distinct orientation on the first inner body;

a plurality of first contacts positioned within the first passages;

first means for attaching the first inner body to the hollow housing shell in a specified plurality of angular orientations, the orientation of the pattern of first passages in the first inner body relative to the first key being different in each angular orientation; and a second connector matable with the first connector comprising:

an outer housing member matable with the hollow housing shell of the first connector and having a complementary second key interfitting with the first key on the hollow shell of the first connector to polarize the first connector relative to the second connector upon mating;

a second inner body fitting into the outer housing member and having a like plurality of complementary second passages arranged in a pattern corresponding to the pattern of the first passages, the first inner body being matable with the second inner body;

a plurality of second contacts positioned within the second passages;

second means for attaching the second inner body to the outer housing member in a like plurality of angular orientations, the orientation of the pattern of complementary second passages relative to the complementary second key being different in each angular orientation;

the first and second inner bodies each comprising inter-engagable front and rear contact holding members wherein the front contact holding member is inter-engagable with the rear contact holding member in a specified plurality of angular orientations, each rear holding member being inter-engagable with the respective hollow housing shell or the outer housing member in only a single angular orientation, whereby a plurality of distinct first and second connectors can be constructed, the first and second contacts of each distinct connector assembly interconnecting conductors in a first ordered array only with conductors in a correspondingly ordered second array.

16. The modular electrical connector assembly of claim 15 wherein the first inner body and the second inner body are interchangeably attachable in the hollow housing shell and in the outer housing member to double the number of distinct assemblies which can be constructed from the interchangeable parts.

17. The modular electrical connector assembly of claim 15 wherein the first inner body has a plurality of posts located on the front face thereof, the first passages extending through the posts, and the second passages form a plurality of cavities extending inwardly from the front face of the second inner body, the posts being received within the cavities when the first and second connectors are mated.

18. The modular electrical connector assembly of claim 17 wherein at least one post and at least one cavity have complementary cross sections, differing from the cross sections of other posts and cavities whereby the plurality of passages are arranged in a distinct pattern on the first and second inner bodies.

19. An electrical connector assembly for interconnecting a plurality of conductors, the assembly comprising matable first and second connectors, each connector having a plurality of terminals located in a housing corresponding terminals being positioned in a distinct orientation in each housing, and latching means on the first and second connectors comprising a plurality of resilient collet fingers on the housing of one connector and an outer shiftable sleeve on the other connector, the resilient collet fingers being deflectable over a surface on the other connector when the outer sleeve is in one position, the sleeve being shiftable over the collet fingers in a second position to prevent disengagement of the collet fingers from the surface; the collet fingers being discontinuously disposed around the housing of the first connector so that a keying surface on the housing of the second connector is received between two collet fingers within the same peripheral surface as the collet fingers to polarize the first connector relative to the second connector for mating so that corresponding terminals in the two connectors are mated.

20. The electrical connector assembly of claim 19 wherein the resilient collet fingers are part of a molded insulative housing.

21. The electrical connector assembly of claim 20 wherein the molded insulative housing comprises a hollow cylindrical housing member.

22. The electrical connector assembly of claim 20 wherein the shiftable sleeve is located on the exterior of a cylindrical housing shell, the raised surface comprising a ridge extending around the cylindrical housing shell and the keying surface comprising at least one raised key extending transversely of the ridge.

23. An electrical connector assembly for interconnecting a plurality of conductors, the assembly comprising matable first and second connectors, each connector having a plurality of terminals located in a body member, a first body member having a plurality of posts insertable within corresponding cavities in the second body member when the two connectors are mated, terminals extending partially through the posts and the cavities to an extent sufficient to permit the terminals in each connector to mate when the connectors are mated, the first body member having a plurality of pillars adjacent to and extending beyond the periphery of the posts, the second body member having a plurality of channels adjacent to and beyond the periphery of the cavities, the pillars being received within the channels when the connectors are mated, the orientation of corresponding posts and cavities and the orientation of corresponding pillars and channels being such that the first and second body members can be mated in only one angular orientation when the connectors are mated, wherein each body member is secured within an outer housing member by attachment to a rear contact holder and the rear contact holder is attached to the outer housing member, each body member being attachable to a rear contact in a number of angular orientations, each rear contact holder being attachable to the corresponding outer housing member in only one angular orientation, so that two connectors can be mated only when each body member is identically oriented relative to the corresponding outer housing member.

24. The connector assembly of claim 23 wherein each body member has at least one first indicia means located on the periphery thereof and each rear member and outer housing member has a plurality of corresponding distinct angularly disposed second indicia means located on the periphery of both the rear members and the outer housing members, the connectors being matable only when the first indicia means on each body member is disposed in the same angular relationship to corresponding second indicia means on the corresponding rear member and outer housing member.

25. The connector assembly of claim 23 wherein the outer surface of selected posts and the inner surfaces of selected corresponding cavities have unique shapes so that the first and second body members can be mated in only one angular orientation when the connectors are mated.

26. The connector assembly of claim 25 wherein the cavities having unique shapes are located between adjacent channels, and the posts having unique shapes are located between adjacent pillars.

* * * * *